United States Patent [19]

Lerstol

[11] Patent Number: 4,891,917

[45] Date of Patent: Jan. 9, 1990

[54] DEVICE IN A BUILDING STRUCTURE

[76] Inventor: Arne M. Lerstøl, Vaekeroveien 185 B, N-0751 Oslo 7, Norway

[21] Appl. No.: 264,274

[22] PCT Filed: Feb. 18, 1988

[86] PCT No.: PCT/NO88/00014

§ 371 Date: Oct. 17, 1988

§ 102(e) Date: Oct. 17, 1988

[87] PCT Pub. No.: WO88/06663

PCT Pub. Date: Sep. 7, 1988

[30] Foreign Application Priority Data

Feb. 24, 1987 [NO] Norway ..... 870763

[51] Int. Cl.[4] ..... E04B 1/34; E04B 1/32

[52] U.S. Cl. ..... 52/1; 52/73

[58] Field of Search ..... 52/73, 223 R, 126.1–126.6; 405/290, 291, 295; 14/3, 5, 7, 8, 31, 32, 36–38, 42

[56] References Cited

U.S. PATENT DOCUMENTS

| | | | |
|---|---|---|---|
| 3,441,317 | 4/1969 | Dommann | 405/295 X |
| 3,477,183 | 11/1969 | Graham | 52/73 |
| 3,591,991 | 7/1971 | Zetlin | 52/73 |
| 3,600,865 | 8/1971 | Vanich | 52/73 |
| 3,913,287 | 10/1975 | Chapman, Jr. | 52/126.1 |

FOREIGN PATENT DOCUMENTS

| | | |
|---|---|---|
| 0020770 | 1/1981 | European Pat. Off. . |
| 395082 | 5/1924 | Fed. Rep. of Germany . |
| 448790 | 8/1927 | Fed. Rep. of Germany . |

OTHER PUBLICATIONS

Engineering News Record, "Suspender Frame Supports Cantilever", Jul. 23, 1953, pp. 32 & 35.
Abstract No. M5510 E/38, SU 881,177.
Abstract No. F4013 K/16, SU 937,597.
Abstract No. 83-819579/46, SU 990,938.

*Primary Examiner*—Richard E. Chilcot, Jr.
*Attorney, Agent, or Firm*—Fleit, Jacobson, Cohn, Price, Holman & Stern

[57] ABSTRACT

Device for use in building structures, particularly large cantilever type roof structures where net weight or variable external loads produce large deformations creating irregularities with respect to adjacent building elements, such as walls, large doors and drive-gates for hangars, workshops, etc., comprising one or more force applying devices (7) disposed between adjacent structural members for producing global displacement of the roof supporting members (2) to obviate the sum of local deformations at critical points of the structure, for example at the supporting rail (4) for drive-gates (5). Such displacement producing force applying devices can also be used for eliminating horizontal displacement of the supporting members.

19 Claims, 6 Drawing Sheets

DEVICE IN A BUILDING STRUCTURE

CROSS REFERENCE TO RELATED APPLICATION(S)

This U.S. application stems from PCT International Application No. PCT/NO88/00014 filed Feb. 18, 1988.

BACKGROUND OF THE INVENTION

1. Field of The Invention

The present invention relates to a device in a building sturcture, especially for supporting structures which by varying load are subjected to deformation.

2. Description of The Prior Art

In connection with large roof stuctures, especially in connection with corbel trees, frame works and suspended roofs, the deformation from the loads may be so large that problems are created for adjacent stuctures, for example walls and gates. Heavily influenced are large sliding gates for hangars, workshops etc. The net weight loads render permanent deformation of the foundation with the underlying loose earth masses or rock, columns, main beams and secondary systems, whereas snow and wind render variable deformations.

In connection with sliding gates for hangars, workshops etc., these have accordingly to be designed in such a manner that jamming is avoided at extremely large loads, a fact which involves a complicated and expensive gate structure and/or costly overdimensioning of the supporting stuctures.

In stuctures having large spans and tall supporting stuctures rendering large non-useable volumes, the necessary heated air volume in such buildings represents an economic factor in pace with increasing energy prices. If the building comprises large gates which are frequently opened, this will entail a total air exchange at frequent intervals, which renders large energy losses and a large and costly heating arrangement for raising the room temperature quickly to a level at which the work activity can proceed.

Further, for the achievement of rational building of hangars and industrial buildings etc., comprising large free spans, great emphasize is laid on quick delivery and assembly of the elements involved in the structure. At the same time, the building should be easy to demount or move.

The prior art known from German Patent DE PS 448.790 relates to a joint splitting of a building for absorbing relative movement within the structure. In other words, here is tought a passive system rendering a pure control of undesired forces, but the system does not give any instructions for a controllable deformation, let alone active displacement elements included as an "integrated" part of the structure.

From German Patent DE PS 395.082,there is known a hydraulic system which by its inertia transfers rapidly applied loads, but which by long time loading produces a permanent deformation of the structure, for example if a larger train should remain on the bridge. The hydraulic system which is included in the prior art building structures, especially bridges and corresponding edifices, is composed of passive elements which to a certain degree monitor unwanted forces, but any form for active displacement for compensating any deformations is not at all the teaching of this prior art technique.

EP-application No. 20770 relates to a method for constructing a space frame work of steel comprising standardized rods. The mounting together takes place substantially on the ground. The structure is raised to its correct height by means of lifting devices, and is given its final form by means of adjustable joints. Thereafter, roof plates are put in position, and no displacement of the structure takes place in the finished building.

BRIEF SUMMARY OF THE INVENTION

The object of the present invention is to provide a device in building structures or a construction thereof at the same time being effected rationally and effectively as regards optimum energy consumption and effective and rapid delivery, mounting and possibly demounting and movement of the elements included in the structures.

The object is achieved in a device in building structures which according to the invention is characterized in that the device comprises one or more active means which can displace one or more members of the building structure.

What is specific to the present invention is the continuous deformation control in critical points of a structure, the structure at the same time being designed so that the costs involved in the implementation of the active means, or lifting means, more or less are balanced by the full utilization of high tensile building materials, and then disregarding the deformation. In other words the building materials can then be dimensioned for loading alone, since all damaging deformation in critical points can be removed by means of the active means, there being achieved, at the same time, a flexible and economic structure.

Because the present device provides a system which works continuously, it is therefore immaterial whether the deformation is due to submergence of the ground, long time deformations or deformations due to short time loadings, for example snow loadings. Further, the specific structures are designed in such a manner that on the basis of a lever principle, there is achieved relatively large movements in the critical points by means of small movements at the active displacement means.

Further, the present invention provides a practical method of erecting a building, such that the free height below the ceiling can be regulated in a short span of time, manually or automatically, without reconstruction and without influencing the stability of the building during the operation.

In other words, by the active means one can displace parts of the building structure, such that the vertical deformations can be neutralized or brought under control at any point of the structure. Alternatively, the means can be used for lifting and lowering the overall, or part of, the roof of a building, for example a hangar, the means being so adapted that the roof can be jacked up or down, at the same time as walls and ports can be re-constructed in a relatively short span of time, or there may be used telescopic gates or walls, such that a desired height of the ceiling can be achieved in a short span of time by the devices controlling the jacks.

Since according to the invention there may be used active means which bring the vertical deformation under control at any point of the building structure, and which at the same time can be used for raising and lowering the members of the structure, there may be used main supporting elements which are dimensioned only in relation to their supporting property, and not in relation to expected deformation, since the deformation is "counteracted" or controlled by the displacement means or lifting devices.

According to the present invention, there may be achieved the following advantages:

a. There is achieved a lighter structure which is dimensioned only for supporting load, since deformation is taken care of by the active displacement means.

b. The structures can be manufactured from all practical materials, for example glued wood which can be rendered more heat resistant than steel.

c. In connection with hangars the sliding gates can be manufactured more easily and with a better sealing.

d. By simple expedients, there are provided building structures, for example hangars, which render large open wall surfaces including sliding gates which facilitate the driving in and driving out of airplanes. Further, there may easily be achieved large ceiling height innermost in the hangar between the anchoring points of the beam arrangement.

e. In connection with structures comprising building elements protruding substantially freely from a central anchoring, there may by means of simple expedients be achieved free through-going height between the anchorings, which allows for free through-driving if gates are mounted in both longitudinal walls.

f. Water on the roof may be drained along the central anchoring, and roof gutters may be omitted.

BRIEF DESCRIPTION OF THE DRAWINGS

In the following the invention will be further discussed with reference to accompanying drawings illustrating embodiments of the device according to the invention wherein.

DETAILED DESCRIPTION OF PREFERRED EMBODIMENT

Figure 1:
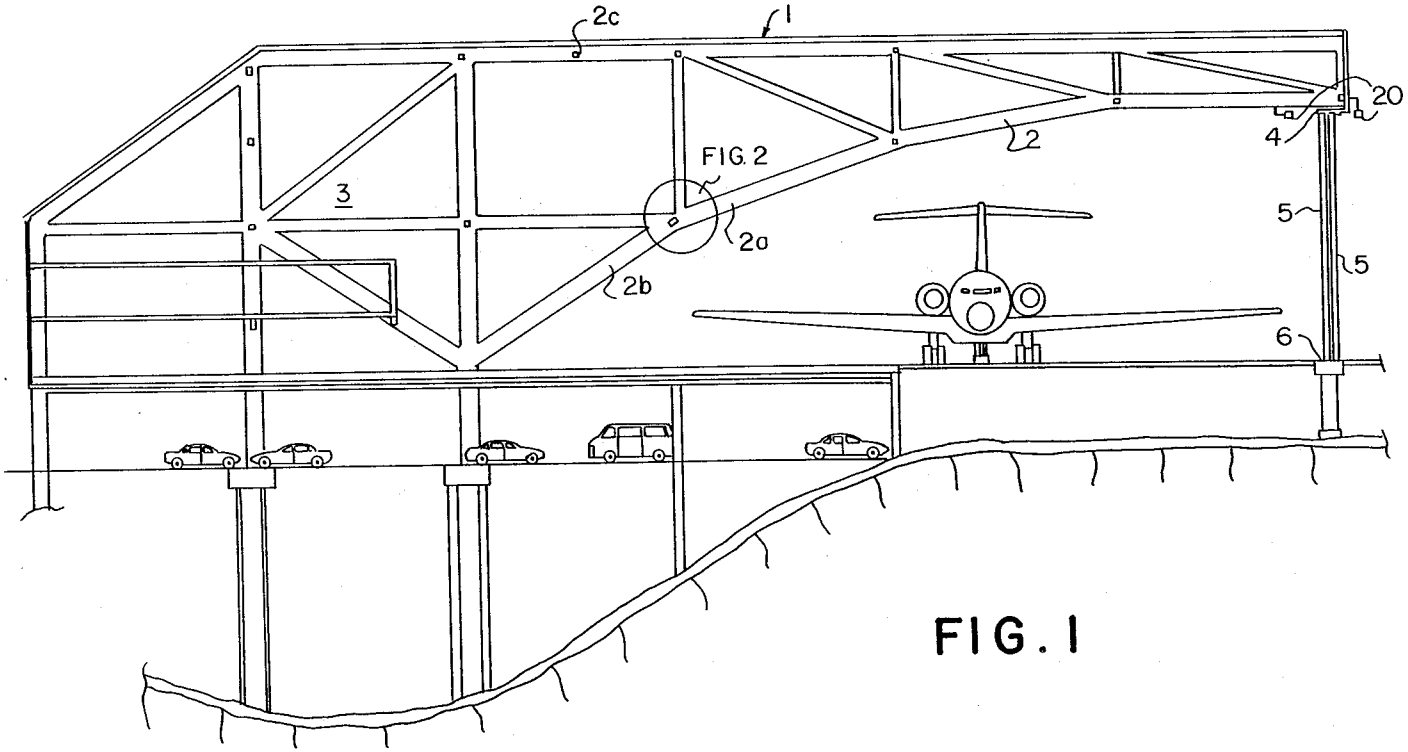
FIG. 1 is a vertical cross-sectional view through a building structure comprising the device according to the invention.

In FIG. 1 there is illustrated a vertical section (cross-section) through a hangar structure which generally is designated by 1, and which comprises a plurality of (corbelled) main supporting members 2, including presure flanges **2*a*, 2*b*, merging into an anchforing, here generally designated by reference numeral 3. At the freely protruding ends of the main supporting members, there are provided supporting rails 4 for a plurality of sliding gates 5, which can be displaced along carrier rails 6 while simultaneously being supported against the supporting rails 4**.

Figure 2:
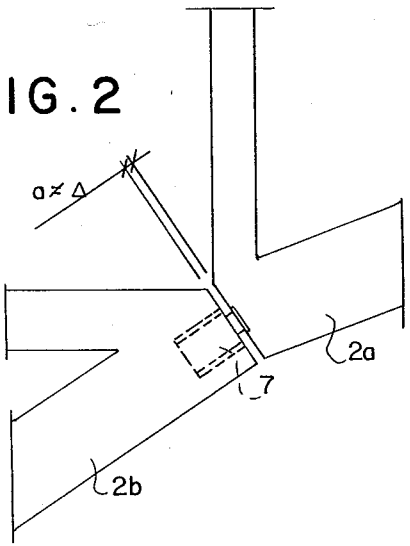
FIG. 2 is a detail of FIG. 1, and illustrates a practical embodiment of the lifting device according to the invention.
Figure 2B:
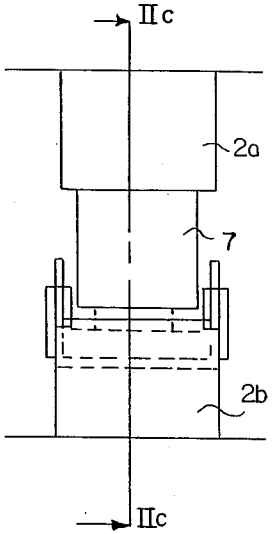
FIG. 2B is a right side elevational view of FIG. 2A.
Figure 2A:
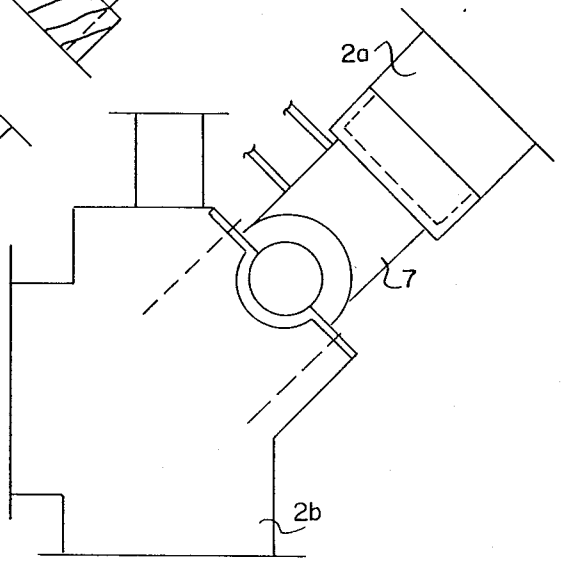
FIG. 2A is an enlarged view similar to FIG. 2 showing a preferred embodiment of the lifting device according to the invention.
Figure 2C:
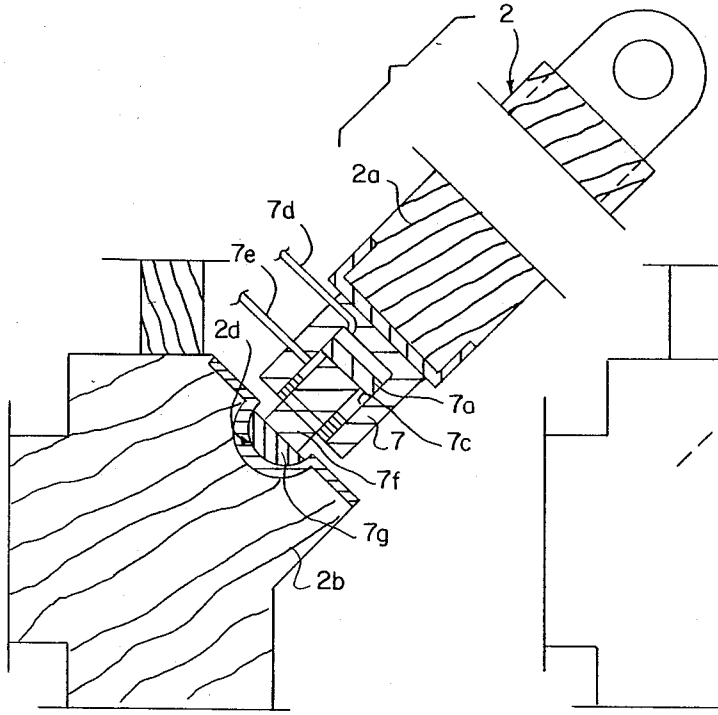
FIG. 2C is a cross-sectional view taken along line II*c*—II*c* of FIG. 2B.

The above discussed problems relating to the deformation of the net weight loading and not at least the varying loadings, will be neutralized by the installation which is illustrated in detail in FIGS. 2A, 2B and 2C and which here as an example comprises a lifting cylinder 7, which is mounted in the pressure flanges **2*a*, 2*b*, of the main supporting member 2. When operating the lifting cylinder 7, it is possible upon global displacement of the main supporting member to neutralize the overall deformation in the critical points of the structure, for example in the area of the supporting rail 4 of the sliding gate 5**. It is to be understood that lifting cylinders can also be mounted in the pressure flange of the secondary beam. When installing a plurality of lifting devices along the pressure flange, it is possible to obtain control of the vertical deformation at any point.

Possibly, one can also control the horizontal displacement of a beam arrangement, said displacement being eliminated by corresponding tensioning devices in the tensioning flange. All units which are incorporated in such a displacement system comprise simple building elements and can include relatively plain marketed components even for the most complicated plants.

It is to be understood that the system can be established either automatically or manually. If an automatic system is chosen there may be mounted photo cells 20, or other sensors, at the critical points, for example in the area of the above discussed supporting rails, for thereby influencing the lifting cylinders in either direction when the photo cells sense certain values. If a manual system is used, it is possible to measure or observe the deformation, whereafter the structure is raised or lowered manually by means of manual control devices.

In connection with the hangar illustrated in FIG. 1, the system will primarily be used to maintain the distance between the supporting rails 4 and the gates 5 constant upon varying loading on the roof, for thereby preventing disturbances of the operation of the gates 5. The structural elements included in the buildings in which the device according to the invention finds application, can be arbitrary, i.e. comprise concrete steel, wood etc. all in dependence on the circumstances.

However, it is to be understood that the structures can be built with elements which are both lighter and having lesser dimensions, since the elements shall only take loads, because the deformation is compensated for by the above discussed displacement means or neutralizing means.

As appearing from FIG. 1, the corbelled main supporting member 2 will constitute a lever having a turning point **2*c* which can be implemented by means of an ordinary bolt link. The lifting cylinder 7 is located in relation to the turning point 2*c* so that upon a certain deflection of the lever, i.e. the corbelled main supporting members in the area of the supporting rails 4, the lever-building-member 2** can be brought back to an appropriate neutral position.

In FIG. 2 there is illustrated an appropriate dimension $a \pm \Delta$ between the flanges **2*a* and 2*b* wherein the lifting cylinder 7 is mounted, and upon alteration of this dimension $a \pm \Delta$, the lever 2** can be raised and lowered all in accordance with the circumstances.

It is to be understood that the device according to the invention can also be applied in connection with building structures comprising a plurality of lever-like building members which can be arranged in parallel side by side, having their free ends protruding in the same direction, and that the device can also be used in those cases in which two or more building members in the form of levers extend from a central anchoring point, there being arranged one or more neutralizing devices for each lever.

The dimension a given in FIG. 2 can correspond to a dimension ready for assembly, whereas the values $\pm\Delta$ can indicate that:

min $= -0.26 \times$ max raising of the supporting rails at maximum upwardly directed loading on roof.

max $= +0.26 \times$ max lowering of supporting rails at maximum downwardly directed load on roof.

It is to be understood that the lifting device or the neutralizing means can be controlled mechanically, manually or by the photo cells 20, the movement taking place step-wise or continuosly. An example of hydraulic equipment for bringing forth a desired raising and lowering of a structure of the type illustrated in FIG. 1, may comprise four one-way operating hydraulic cylinders including mechanical load blocking. Appropriately, the cylinder may have a stroke length 150 mm and a capacity of 600 tons. This equipment requires an electric pump, for example of a capacity of $4 \times 2.5$ 1/min, as well as a three-way electic valve.

FIG. 2 shows schematically the position of a hydraulic cylinder-piston assembly. FIGS. 2A, 2B and 2C show a preferred embodiment wherein cylinder 7 has been adapted to be mounted on the lower end of pressure flange 2*a*, cylinder 7 having a piston 7*a* operating in a piston chamber 7*c* receiving oil supplied at the upper side of the piston 7*a* through a first oil conduit 7*d*, and also receiving oil supplied through another oil conduit 7*e* at the other side of the piston 7*a*. Piston rod 7*f* extends out from the lower end of cylinder 7 and is provided with a hemispheric end portion 7*g*, which is supported in a concave shell portion 2*d*, constituting a reinforcement end piece of the other pressure flange 2*b*.

If FIG. 2A is compared with FIG. 2, it will be understood how the appropriate dimensions a$\pm$ between flanges 2*a* and 2*b*, wherein the lifting cylinder 7 is mounted, can be changed in accordance with circumstances, i.e. lever 2, as illustrated in FIG. 1, can be lowered and raised in accordance with the corresponding distance between supporting rails 4 and associated gates 5.

For the equipment there are required hoses with quick couplings as a well as throttle valve (not shown) for each lifting cylinder, for controlling the lowering of the load.

Further, there are required four hose rupture valves, a control unit, and amplifier as well as an indicator and a level switch.

As stated above, it is to be understood that the system can be operated either automatically or manually. If an automatic system is chosen there may be mounted the photocells 20, or other sensors, at the critical point which is to be monitored, and which initiate the supply of oil through either oil conduit 7*d* for raising the supporting member 2, or through the oil supply conduit 7*e* for lowering the supporting member 2. Such a critical point may for example be in the area of the supporting rails 4, where the photocells 20 will be disposed for operation to detect a predetermined distance between the supporting rails 4 and the associated gates 5 which is critical. Each photocell is connected to the valve operator so that when it detects this value it will emit a signal in a known manner to operate the appropriate valves controlling oil supply in conduits 7*d*, 7*e* to actuate cylinder 7 to move the supporting member 2 in order to prevent disturbances of the operation of gates 5.

Each of the four lifting cylinders may be connected to its individual oil supply line electromagnetically controlled valve. Desired outward displacement can be preset on a control panel (not shown), and all four valves can be activated simultaneously by means of a remote control handle (not shown). Upon achieved desired outward displacement, the control unit will break the current to the valve, and this will then take a stop position. The stroke length sensors included in the control unit, can have an accuracy of 0.4% linearly, and because every cylinder has its own oil supply, the outward displacement will take place approximately synchronously.

If a manually operated system is used, it is possible to measure or observe the deformation, which is done by an inspector, and the inspector can, if his observation reveals critical deformations, manually raise or lower the supporting member 2 until the distance between the supporting rails 4 and the associated sliding gates 5 is within acceptable limits.

However, it should be clear that the only parameter which is registered, whether this registration takes place by means of photocells, electric contacts, or by visual inspection, is the clearance between the rails and gates, particularly where the present device is used in connection with large hangars. It is presumed that in most cases a manual adjustment of the hydraulic cylinders would be sufficient, but it might also be advantageous to provide for adjustment of the cylinders to take place automatically by letting specific distance between the rail and the gate start or stop the oil pumps, approximately corresponding to the jacking up of a "sliding casting frame" or a "climbing casting frame".

In FIGS. 3–8 there is illustrated a second example of how the device according to the present invention can find application.

In view of constantly increasing energy prices, the air volume to be heated in a building is of large economic consequence. Especially in connection with structures having large spans and tall supporting structures rendering large non-usable volumes, for example in connection with large halls as workshops, hangars etc., this question is of substantial interest. If such buildings comprise large gates which often are opened, there will occur a frequent total exchange of air, which involves large losses of energy, and corresponding large installation costs as regards the means for heating for regaining the indoor temperature as fast as possible to a level at which the work activity may continue.

Generally, a solution for reducing the energy loss upon opening of gates, involves a membrane or an isolator at the lower edge of supporting structures, the membrane or the isolator preventing the outflow or the cooling of the upper air layer upon short gate opening.

Figure 3:
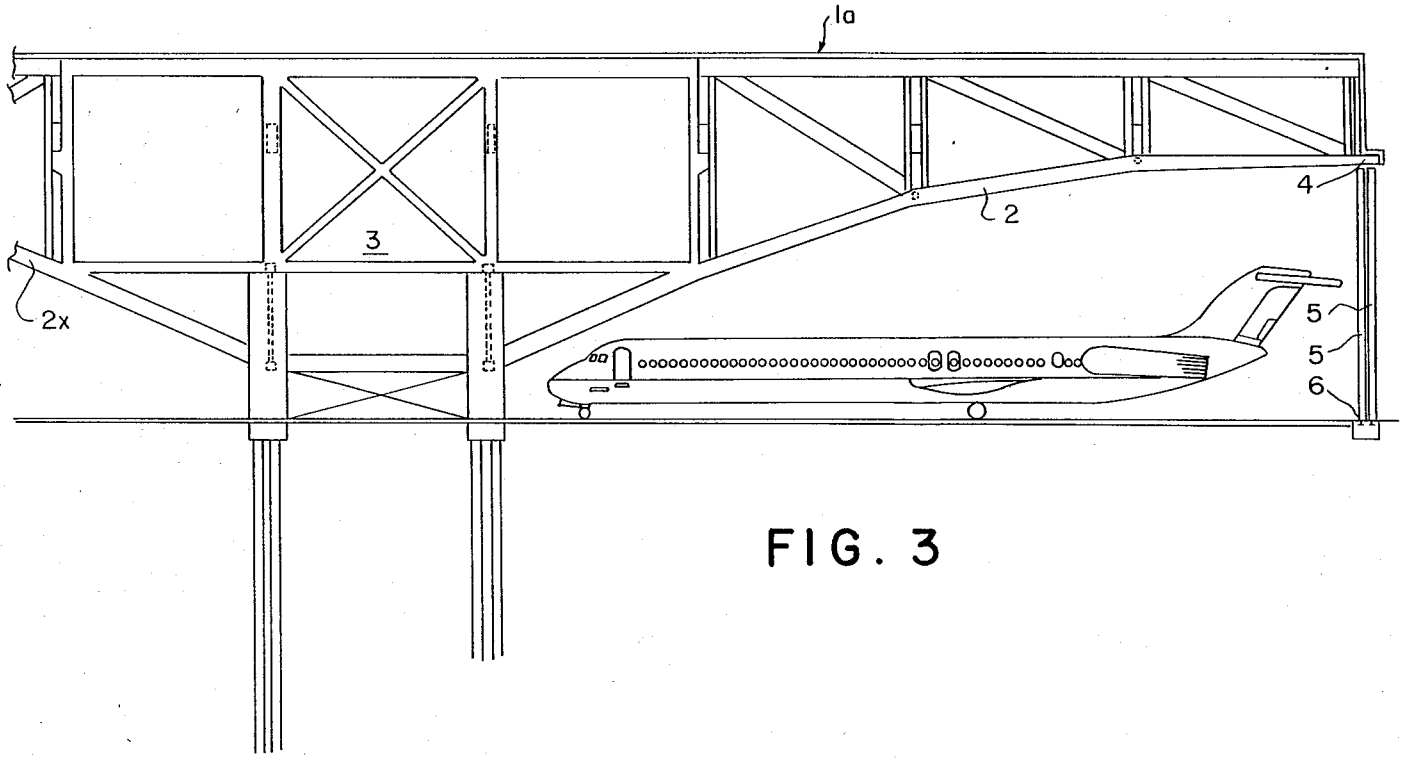
FIG. 3 is a view similar to FIG. 1 through a building structure, wherein a second embodiment of the device according to the invention is included.
Figure 4:
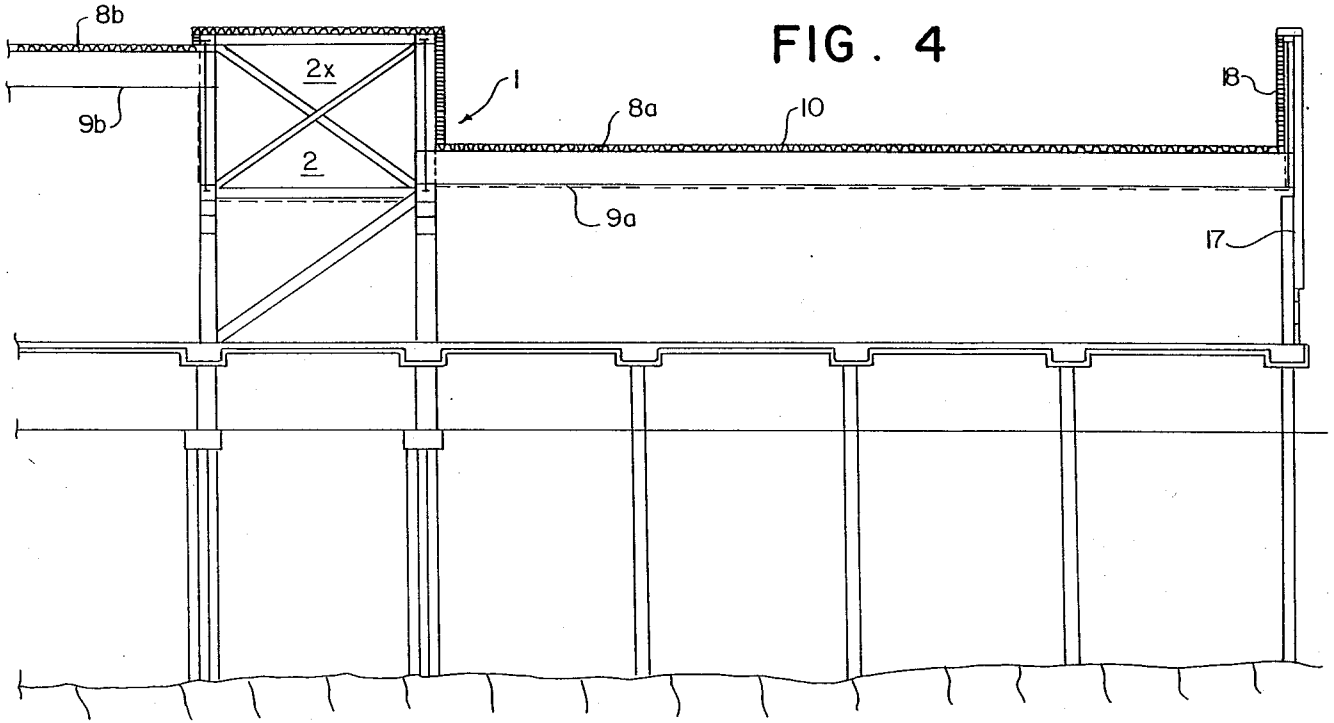
FIG. 4 is a longitudinal cross-sectional view through the building structure illustrated in FIG. 3.
Figure 8:
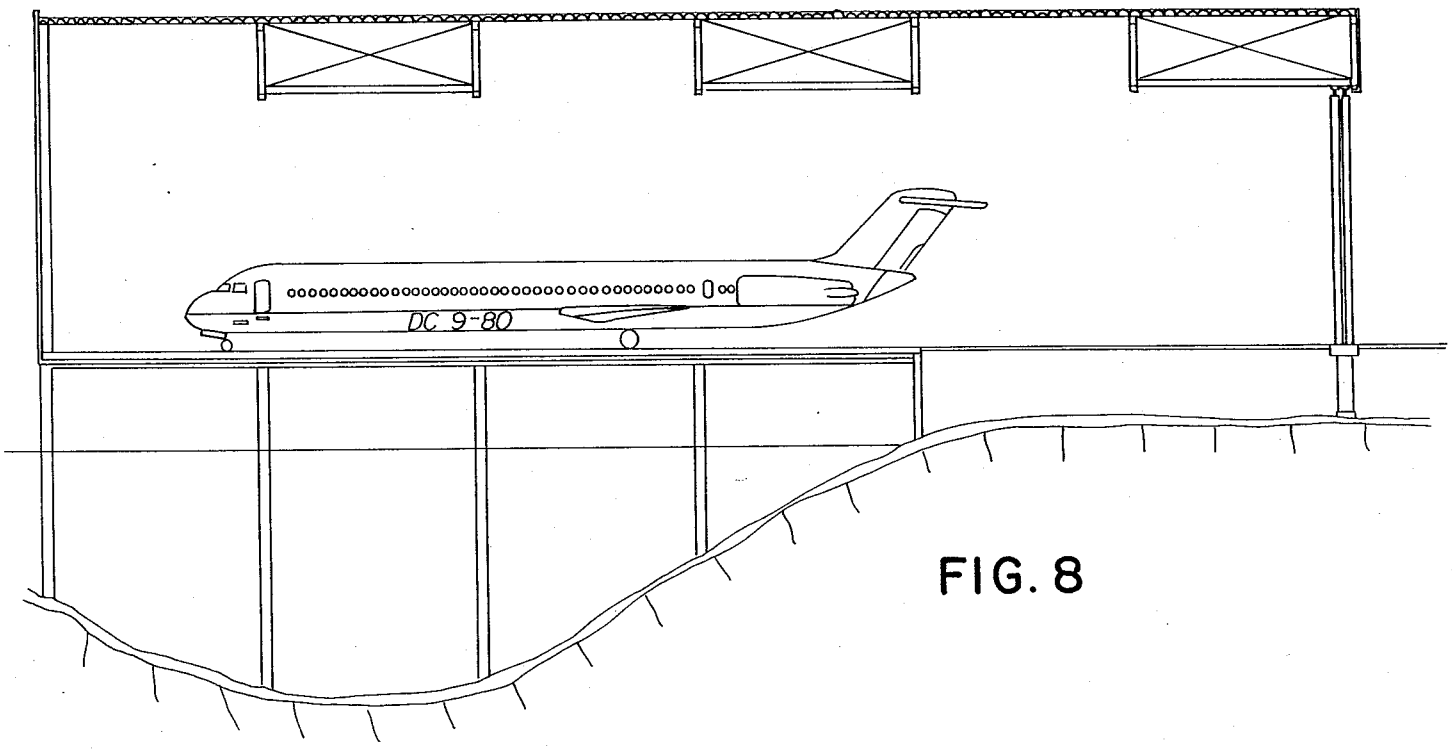
FIG. 8 is a cross-sectional view through secondary supporting members illustrated in FIG. 4.

In a building 1*a* which is illustrated in FIGS. 3 and 4 and which comprises corbelled main supporting members 2 extending in the one direction from an anchoring 3, as well as main supporting members 2*x* extending in the opposite direction to the main supporting member 2, but from the same anchoring 3, there is illustrated an example of secondary supporting members 8a and 8b, arranged between the main supporting members 2, 2x, respectively, and carrying a membrane 9a and 9b, respectively, preventing air exchange upon opening of sliding gates 5.

A further development of the system involves the inclusion of displacement devices which can raise or lower the roof 10 between the main supporting members 2, 2x, the level of the roof being adapted to the room height required by the building for allowing mounting or driving access of the equipment or the vessel which are to enter the building. This arrangement including a roof which can be jacked up or down is especially useful in connection with for example airplane hangars, wherein the size of the airplanes is an unknown factor, especially as regards the renovation of the airplane fleet. The height to the ceiling can thus be varied in the same building according to requirements.

As regards walls and gates which are to be adapted to the adjustable roof, these may be shaped either such that they can be rebuilt in a relatively short period of time, or there may be used telescopic gates and walls. By using the latter telescope solution, the desired roof height can be achieved in a few minutes by means of for example a mechanism controlling hydraulic units.

Figure 7:
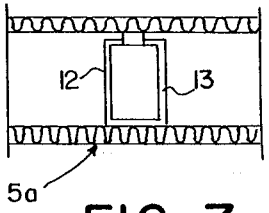
FIG. 7 is a horizontal cross-sectional view through a part of the sliding gate illustrated in FIGS. 5 and 6.
Figure 6:
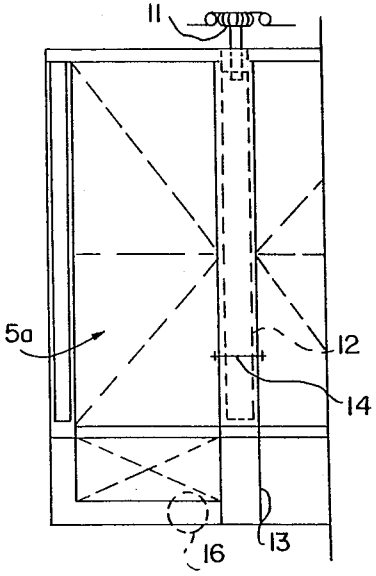
FIG. 6 is a front elevational view of the sliding gate illustrated in FIG. 5.
Figure 5:
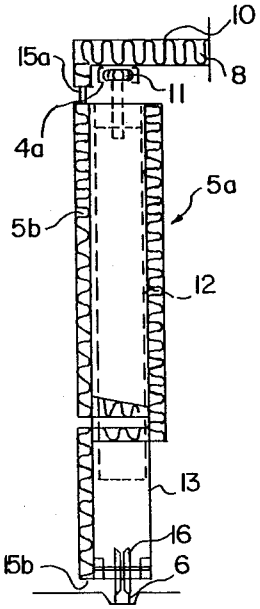
FIG. 5 is a vertical cross-sectional view through a sliding gate which can be used in connection with the building structure illustrated in FIGS. 3 and 4.

In FIGS. 5, 6 and 7 referring to a vertical section, a front view and a horizontal section, respectively, in connection with an embodiment for a telescopic gate 5a, the upper part of the gate 5a is via a control roller 11 mounted in a supporting rail 4a, which in turn is attached to the secondary supporting member 8, which constitutes a part of the roof 10.

The upper part 5b of the gate 5a will upon raising of the roof 10, be lifted together with the inner square tube 12 which is mounted in an outer square tube 13 for the achievment of a telescopic effect. Thus, the inner pipe 12 may slide in the outer pipe 13, and be locked in the desired position, by means of for example a locking bolt 14. At the top and at the far bottom of the gate 5a there are provided sealing brushes 15a and 15b, respectively. At the bottom, the gate is rolling on a carrier rail 6 by means of appropriate carrier wheels 16.

In FIG. 4 there is to the right illustrated a permanent wall 17 as well as a telescopic wall 18 constituting a sealing against the roof 10, and following this in the raising and lowering movements thereof. This telescopic wall can co-operate with the raising and lowering of the secondary supporting members 8a, 8b, and the displacement devices effecting the raising and lowering may comprise climbing rods, jacks or similar devices.

In FIG. 4 there is to the right illustrated the secondary supporting member 8a in its lowered position, whereas to the left there is illustrated a secondary supporting member 8b in its raised position. With such a system, the roof height may be varied in the same building according to need, i.e. within various areas of the building, which is favorable as regards the energy consumption in heating, as well as regards the flexibility in connection with the size of the objects or vessels to be housed by the building.

Appropriately, such a building structure as illustrated in FIG. 3, i.e. including large roof surfaces and including main supporting members protruding from a common, substantially central set of anchoring columns, may comprise a drainage system which is brought into the central points in the area of the anchoring columns, wherein the water is brought down in telescopic drainage pipes. The drainage system may of course be used without adjustable roofs, and vice versa.

By using the device as discussed above, there is achieved a rational and effective construction of hangars and industrial buildings, or similar constructions, having large free spans, there often in connection with such buildings being paid considerable attention to rapid delivery and mounting of all elements, as well as to easy demounting and the moving of the building.

The secondary beams can also be located at modular spacing, said beams being connected in pairs by bracings at both flanges, and cross-bracings between the flanges, such that box girders having modular width can be finished on the ground and be lifted up by a crane. If desired, the roof elements which are covered by a layer of roofing cardboard may also be mounted before the lifting.

After the secondary supporting units including covering have been mounted, there may be mounted roof plates on the open areas, still at modular width, between the units, there being provided finished roofs on both sides of the openings.

The outer walls which also rest on columns having modular spacing, can be built up by wall elements having modular length.

If it is also desired to have column-free gables, it is also possible to arrange corbelled frame works from the nearby tower out towards the gable walls. These may be considered as a main supporting member for the main supporting member of the gable. Consequently, all outer walls may be made column-free, and in connection with airplane hangars, all the airplanes are then allowed to be driven in from all directions and taking any position without being interfered with by columns or similar. The airplane truck is allowed to drive below the bracings of the tower, and the tower will thus not prevent the use of vehicles having regular height.

In a building structure without walls, the drainage of roof water constitutes a problem, but this is solved in that all roof surfaces have a small inclination towards the tower structure, which is indicated in FIG. 3. As an example roof water from a roof surface covering 5–10,000 $m^2$ can be drained down at each point, possibly in a plurality of pipes being provided due to the danger of clogging. This renders a good economy since the roof gutters are dispensed with, there are achieved few and large down-pipes, as well as simple foundation pipes etc.

Such a modular construction of buildings, especially halls having large open wall portions, or without walls, is especially favorable in connection with the above discussed displacement devices, since the deformation problems which always have represented a difficulty in large structures, are brought completely under control. The system involves not only the advantage that it can be built on a modular basis, but additionally, the modules can be built up of all known building materials, such that rise building style, environment etc. can be attended to, all in accordance with circumstances.

In this form of modular construction including central anchoring points, a building project may be preestimated to a very advanced stage, without having knowledge of all details relating to the ground. Also in connection with various forms of foundation, there may be achieved large cost savings if the present invention is brought into practice, since deformations and settlement represent circumstances which can be adjusted after the erection of the building.

What is claimed is:

1. Device for use in a building structure having a supporting structure of connected supporting members subject to deformation from an initial position due to its own weight and/or varying external forces comprising:

at least one force applying means operatively mounted on said supporting structure for displacing at least one of said supporting members with respect to at least one adjacent supporting member after deformation to restore the supporting structure to the initial position.

2. Device as claimed in claim 1 wherein:

said supporting structure comprises at least one main supporting member and two pressure flanges at least partly supporting said at least one main supporting members; and said at least one force applying means is mounted in at least one of said pressure flanges.

3. Device as claimed in claim 2 wherein:

said at least one force applying means is mounted between said pressure flanges.

4. Device as claimed in claim 3 wherein:

said at least one force applying means comprises double acting hydraulic cylinder-piston means;

hydraulic fluid supply means is operatively connected to said cylinder-piston means; and photo-cell means are provided for detecting the amount of deformation from the initial position and for controlling operation of said hydraulic cylinder-piston means by said hydraulic fluid supply means.

5. Device as claimed in claim 4 wherein:

the cylinder of said hydraulic cylinder-piston means is mounted on one of said pressure flanges; and the piston of said hydraulic cylinder-piston means engages with the other of said pressure flanges.

6. Device as claimed in claim 1 wherein:

said at least one force applying means comprises hydraulic jack means.

7. Device as claimed in claim 1 wherein the building structure includes an anchoring part and said supporting structure subject to deformation extends from the anchoring part as a substantially cantilever supporting structure having a substantially unsupported outer end displaceable by the deformation from an initial position, wherein:

said supporting structure comprises a pivot means; and said at least one force applying means is positioned with respect to said pivot means for displacing said supporting structure about said pivot means to substantially maintain said outer end in said initial position.

8. Device as claimed in claim 7 wherein:

said supporting structure comprises at least one main supporting member and two pressure flanges at least partly supporting said at least one main supporting member; and said at least one force applying means is mounted in at least one of said pressure flanges.

9. Device as claimed in claim 8 wherein:

said at least one force applying means is mounted between said pressure flanges.

10. Device as claimed in claim 9 wherein:

said at least one force applying means comprises hydraulic jack means.

11. Device as claimed in claim 7 wherein a plurality of said substantially cantilevered supporting structures extend in parallel spaced relationship from said anchoring part wherein:

a force applying means is provided for each cantilever supporting structure; and said force applying means are synchronously operated.

12. Device as claimed in claim 1 wherein:

said at least one force applying means comprises:

first force applying means for displacing said at least one of said supporting members to correct substantially vertical deformation thereof; and further force applying means for displacing said at least one of said supporting members to correct substantially horizontal deformations thereof.

13. Device as claimed in claim 1 wherein:

said supporting structure is comprised of a plurality of supporting members extending in parallel spaced relationship to form a cantilevered supporting structure having a substantially unsupported outer end wherein:

said plurality of supporting members are arranged to form a plurality of cooperating groups of cantilevered supporting structures;

a force applying means is provided for each group; and said force applying means are adapted for synchronous operation.

14. Device as claimed in claim 13 wherein the building structure includes a central anchoring part and said supporting structure is comprised of a plurality of supporting members connected together to form a plurality of cantilevered supporting structures extending from the anchoring part wherein:

at least one of said force applying means is provided for each cantilevered suporting structure.

15. Device as claimed in claim 14 wherein:

said plurality of cantilevered supporting structures extend in opposite directions from said anchoring part.

16. Device as claimed in claim 1 wherein a plurality of main supporting members extend in spaced relationship from at least one anchoring part of the building structure wherein:

a plurality of secondary supporting members are supported between said main supporting members; and a plurality of active displacement means are provided for raising and lowering said secondary supporting members.

17. Device as claimed in claim 16 wherein:

said active displacement means comprise climbing rods.

18. Device as claimed in claim 17 wherein:

said building structure further comprises wall means;

said active displacement means is provided on said wall means;

a roof is supported on said secondary supporting members; and telescopic wall means are connected between said active displacement means and said secondary supporting members for supporting said secondary supporting members.

19. Device as claimed in claim 18 wherein:

vertically telescopic and horizontally sliding gates are provided for closing openings in said building structure;

connecting means are provided for connecting said gates to said roof and;

sealing brush means are provided between said gates and said roof.

* * * * *